United States Patent [19]

Kurrle

[11] 4,158,990

[45] Jun. 26, 1979

[54] AIR DISTRIBUTION BOX

[75] Inventor: Hermann Kurrle, Kolbingen, Fed. Rep. of Germany

[73] Assignee: Schako-Metallwarenfabrik Ferdinand Schad GmbH, Kolbingen, Fed. Rep. of Germany

[21] Appl. No.: 854,036

[22] Filed: Nov. 22, 1977

[30] Foreign Application Priority Data

Nov. 23, 1976 [DE] Fed. Rep. of Germany ..... 2653161

[51] Int. Cl.[2] ..... F24F 7/00; F24F 13/00

[52] U.S. Cl. ..... 98/40 D; 98/41 R

[58] Field of Search ..... 98/40 D, 41 R, 41 AV, 98/41 SV, 2.14

[56] References Cited

U.S. PATENT DOCUMENTS

| | | | |
|---|---|---|---|
| 2,890,717 | 6/1959 | Werder | 98/41 R |
| 3,298,299 | 1/1967 | Little et al. | 98/41 R |
| 3,507,354 | 4/1970 | Dieckmann et al. | 98/40 D |
| 3,750,839 | 8/1973 | McNabney | 98/41 R |
| 3,974,755 | 8/1976 | Honmann | 98/40 D |

*Primary Examiner*—Ronald Feldbaum

*Attorney, Agent, or Firm*—Blair, Brown & Kreten

[57] ABSTRACT

An air distribution box for ventilating and air conditioning systems with a socket for the connection to the air duct system, with at least one outlet into the room which is to be ventilated and with a flap for adjusting the flowrate for the delivered or discharged air, in which the adjustable flap is disposed on the socket in the interior of the box and is adapted to adjustably close the socket aperture.

8 Claims, 3 Drawing Figures

AIR DISTRIBUTION BOX

FIELD OF THE INVENTION

The invention relates to an air distribution box for ventilating and air conditioning systems with a socket for connection to the air duct system, with at least one outlet to the room which is to be ventilated and with means for adjusting the flowrate of the delivered or discharged air.

The purpose of air distribution boxes, which are generally inserted into the ceiling of the room which is to be ventilated, is to receive the delivered air discharged from the air duct system of the ventilating or air conditioning system in the manner of a buffer volume before the said air enters through the outlet into the room which is to be ventilated. This insures a more uniform and draught-free discharge of the inlet air through the outlets.

BACKGROUND OF THE INVENTION

To improve uniform distribution of the inlet air still further, it is known to provide such air distribution boxes with a perforated plate near the outlet to function as an equalizer and to prevent turbulence of the air flow at the outlet. Such perforated equalizer plates are of course not required if the air distribution box is used as an air discharge box through which the air is discharged from the ventilated room into the air duct system.

It is frequently necessary for the quantity of air which is delivered or discharged via an air distribution box to be adjustably varied. In known air discharge boxes the air flowrate was adjusted at the outlet into the room which is to be ventilated by variation of the cross-section of the outlet ports through adjustable flaps or plates. This procedure suffers from the disadvantage of preventing uniform flow of the air through the outlet due to the flowrate adjustment on said outlet, an effect which in turn leads to undesirably noise. The action of the perforated equalizer plates provided in inlet air distribution boxes is therefore partially eliminated by the flowrate adjusting means.

OBJECTS OF THE INVENTION

It is the object of the invention to eliminate these disadvantages and to provide an air distribution box in which the rate of flow of the air supplied thereto or delivered therefrom can be adjusted with simple means but without undesirable noises resulting from intensive restriction of the amount of air.

In an air distribution of the kind described hereinbefore this problem is solved in accordance with the invention in that the means for adjusting the flowrate comprise an adjustable flap which is mounted in the interior of the box on the socket and adjustably closes the socket aperture.

The adjustable flap can be a perforated plate or it can be an imperforate plate.

The important advantage of the air distribution box according to the invention is due to the fact that the means for adjusting the flowrate are disposed not on the outlet into the room which is to be ventilated, but on the connecting socket by means of which the box communicates with the air duct system. The buffer volume of the distribution box is therefore always situated between the outlet into the room that is to be ventilated and the restrictor place formed by the adjustable flap, at which said restrictor place noise is produced when the adjustable flap is partially closed. Turbulence resulting from restriction of the air flow and leading to noise can thus be equalized and settled in the adequately large volume of the air distribution box so that the air emerges or enters at the outlet uniformly and noiselessly. As regards the cross-section and shape of the outlet port, this can be of optimum and unvarying construction, independent of the flowrate setting.

If the air distribution box according to the invention is used as the inlet air box, it will be advantageous in a further embodiment of the invention to subdivide the interior of the box by a perforated plate which is situated as close as possible to the adjusting range of the adjustable flap and adjoins the same. This provides the additional advantage that the greater part of the box volume is situated not only behind the flowrate adjusting flap but also behind the perforated equalizing plate. The inlet air which enters through the socket via the restrictor place formed by the flowrate adjusting flap therefore enters the box volume practically free of turbulence because of the presence of the perforated plate so that complete settling and equalization of the air flow is insured at the outlet.

To this end, the perforated plate is advantageously mounted at an angle in the interior of the box. This procedure offers the additional advantage that the inlet air which flows via the restrictor place strikes the entire surface of the perforated rectifier plate practically at the same angle and with the same quantitative distribution. The inlet air therefore enters the relatively large distribution box space behind the perforated plate not only free of turbulence but also already in uniform districution.

One embodiment of the invention, which is of particularly simple construction, is obtained if the adjustable flap is attached so that it can pivot against the socket aperture. This step also offers the advantage that the perforated equalizer plates, which are provided for the inlet air distribution boxes, can be disposed very close to the flowrate adjusting flap, more particularly when set at an angle.

Furthermore, in this embodiment of the invention the adjustable flap can be pivotally constructed by means of a spindle which is brought out of the box on the outlet side. The flowrate can thus also be varied conveniently from the outside, even in installed boxes. If the spindle is also retained on the box so as to be axially immovable but pivotable and the adjustable flap is connected by means of a jointed lever to a screw threaded sleeve disposed on the spindle, it will be possible for such adjustment to be conveniently and reliably performed at the same place.

In a further embodiment of the invention, the pivoted position of the adjustable flap is defined by a spring. The spring pressure will then always insure a specific position of the flowrate adjusting flap. The pivoted position of the adjustable flap can be altered by moving the point at which the spring acts.

The air distribution box according to the invention leads to a substantial reduction of noise, which is particularly advantageous when the air supply is substantially restricted. A restriction to give a pressure difference of 5 mm WG is readily possible with the inlet air distribution box according to the invention without resulting in any undesirable noise. Such restriction without undesirable noise in known inlet air distribution boxes was hitherto possible only with a pressure difference of up to 2 mm WG. A high degree of restriction is important more particularly for adjusting systems with a substantial number of outlets in the ceiling. The high degree of restriction leads to a low pressure drop in the air duct so that all ceiling outlets can be readily adjusted to the same air flowrate. This dispenses with the need for lengthy adjustment of the flowrate on site when the system is installed. Minor readjustments for equalizing the air flowrates of the individual outlets can be simply and rapidly made with the air distribution boxes according to the invention.

The air distribution box according to the invention is equally suitable for square, rectangular and round ceiling outlets.

BRIEF DESCRIPTION OF THE DRAWINGS

Embodiments of the invention will be explained hereinbelow by reference to the accompanying drawing, in which.

DESCRIPTION OF THE PREFERRED EMBODIMENTS

Figure 1:
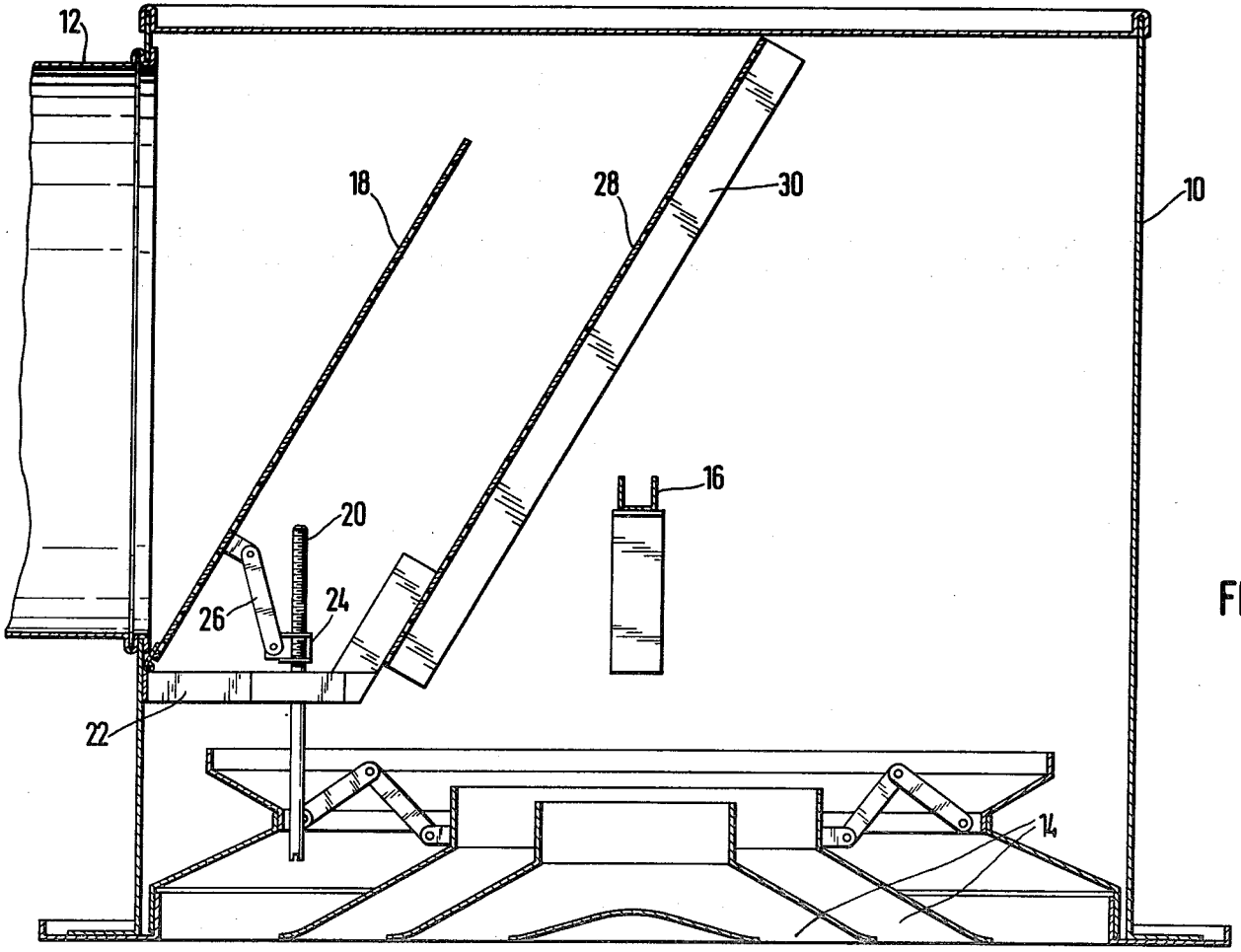
FIG. 1 is a section through an air distribution box according to the invention, constructed as an inlet air box.

FIG. 1 shows an air distribution box 10 which is connected through a socket 12 to the air duct system, not shown, of an air conditioning plant. The air distribution duct 10 is inserted into the ceiling of a room and opens into the said room by means of a ceiling outlet 14. The ceiling outlet 14 in this case comprises funnel-shaped diffuser blades which are not described in detail. A channel section rail 16 is inserted transversely in the box 10 for the purpose of mounting and stiffening.

An adjustable flap 18 is pivotally mounted on the internal wall of the box 10 beneath the socket 12 and adjoining the same. The adjustable flap 18 comprises a perforated plate and can be continuously pivoted between an open position shown in FIG. 1 and a closed position in which it bears upon the aperture of the socket 12.

Pivoting is performed by means of a spindle 20 which is pivotally but axially fixedly retained by a girder section 22 which extends transversely through the box 10. A screw threaded sleeve 24, to which a lever 26 is pivoted, is situated on a screw threaded portion of the spindle 20 that projects beyond the girder section 22. The other end of the lever 26 is hinged to the adjustable flap 18. The bottom end of the spindle 20 is accessible via the outlet 14 and is provided at the said bottom end with a slot so that the spindle can be rotated by means of a screwdriver. The rotation causes displacement of the screw threaded sleeve 24 and thus causes the adjustable flap 18 to be pivoted.

Pivoting of the flap 18 enables the amount of inlet air which enters the box 10 through the socket 12 to be varied between a maximum value when the flap is completely opened, as illustrated in FIG. 1, and a minimum value when the flap is completely closed, when air passes merely through the perforations of the flap 18.

A perforated plate 28 is inserted at an angle in the box 10 and divides the interior of the box into a smaller volume nearest to the adjustable flap 28 and a larger volume nearest to the outlet 14. The perforated plate 18, functioning as an equalizer, extends approximately parallel with the adjustable flap 18 when this is in the position of maximum opening. This enables the perforated plate 28 to be disposed as close as possible to the adjustable flap 18 without obstructing the pivoting motion thereof. A maximum volume of the box 10 on the side of the perforated plate 28 nearest to the outlet 14 is thus obtained.

The bottom edge of the perforated plate 28 is attached to the girder section 22 and its side edges are attached by means of an angle section 30 to the side walls of the box 10.

Figure 2:
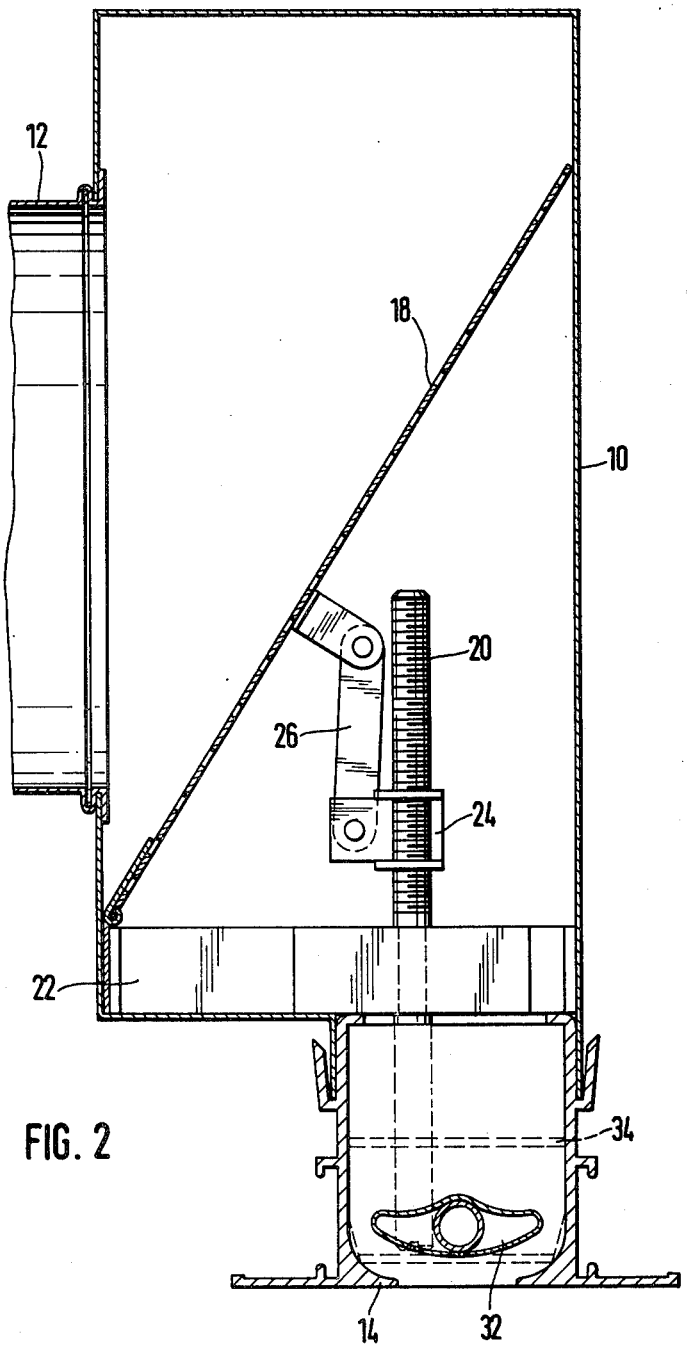
FIG. 2 is a section through another embodiment of the air distribution box according to the invention, constructed as an exhaust air box.
Figure 3:
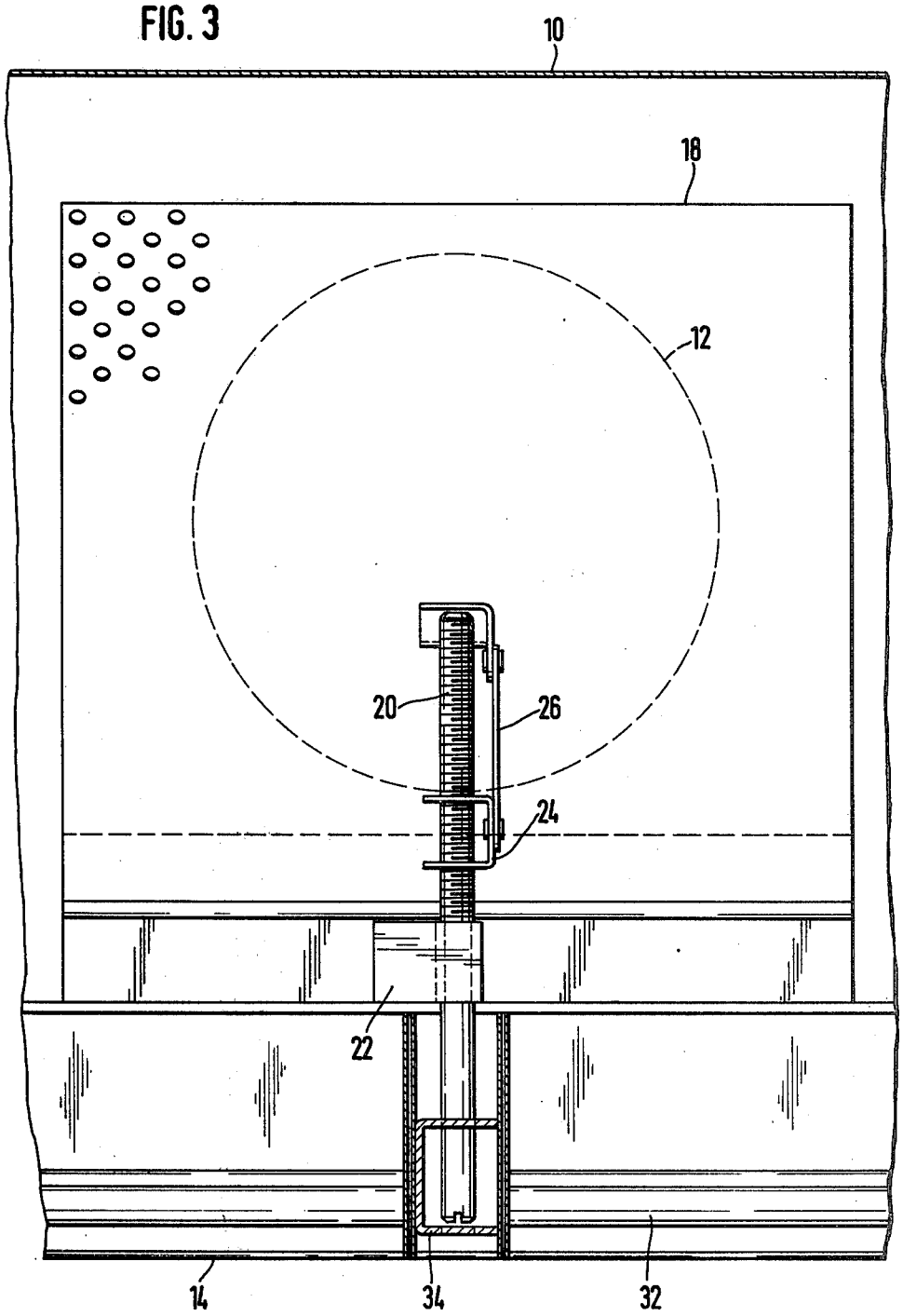
FIG. 3 is a side view from the right of the air distribution box of FIG. 2, with the right side wall removed.

FIGS. 2 and 3 show an air distribution box the important parts of which correspond with those of the box of FIG. 1. Corresponding parts therefore have the same reference numerals as those in FIG. 1 and reference should be made to the description of FIG. 1.

Differences in relation to the box illustrated in FIG. 1 consist more particularly in the air distribution box illustrated in FIGS. 2 and 3 having no perforated equalizer plate. Advantageously, this box is therefore suitable for use as an exhaust air distribution box. However, even when used as an inlet air distribution box it will have advantages compared with conventional boxes. However, the use of a perforated equalizer plate is generally preferred for inlet air distribution boxes.

The sectional part 22, which axially defines the spindle 20 in the box of FIGS. 2 and 3, bears on the bottom wall of the box 10, thus substantially simplifying these retaining means. A short sectional strip 22 is sufficient, as can be seen by reference to FIG. 3.

In the box of FIGS. 2 and 3, the ceiling outlet 14 is constructed as an elongated louvered outlet which is inserted into the ceiling and in which a diffuser blade, extending longitudinally, is pivotally disposed. The spindle 20 extends downwardly in the louvred outlet 14 and is retained at its bottom end by a U-shaped plate 34 so that the spindle 20 is always accessible at the same place to facilitate convenient operation of the flowrate adjusting flap in the outlet 14. Vane 32 serves as a final air director prior to the air's emergance into the room.

Having thus described the invention it will be apparent that various structural modifications are contemplated as being part of this invention as set forth above and defined below by the claims.

What is claimed is:

1. An air distribution box for ventilating an air conditioning systems having an air socket, the combination comprising:

an air distribution box of substantially rectangular configuration having one side wall provided with an opening for registry with said air socket, a bottom wall provided with openings to allow air to pass therethrough, a girder extending into said air box connected to said one side wall and disposed just below said opening on said side wall, an adjustable flap having an surface area substantially that of said air socket and therefore of said opening in said side wall, pivotally supported substantially at the juncture of said one side wall and said girder, and means to orient said adjustable flap from a position of complete registry with said opening, defining a closed position to an open position.

2. The device of claim 1 in which said means to orient said adjustable flap comprises a spindle extending through and supported on said girder, said spindle having a threaded portion above said girder, a screw threaded sleeve disposed on the spindle's threaded portion, a lever pivoted at one extremity to said screw threaded sleeve and pivoted at its other extremity to said adjustable flap whereby when said spindle is rotated, said screw threaded sleeve traverses up and down the threaded portion of said spindle and said adjustable flap opens when the sleeve is at its lower most position and closes as the sleeve moves up.

3. Air distribution box according to claim 2, in which the adjustable flap has perforations.

4. Air distribution box of claim 3 in which a perforated plate subdivides the interior of the box into a major area nearest the bottom wall and a minor area nearest the socket and is disposed on said girder and substantially parallels said adjustable flap when said flap is completely open.

5. Air distribution box according to claim 4, in which the perforated plate is inserted at an angle in the interior of the box.

6. The device of claim 5 in which said perforated plate is further supported by angle sections connected to opposed side walls which are next to said one side wall having an opening.

7. The device of claim 6 in which a channel section rail extends between said opposed side walls below said perforated plate to strengthen said box.

8. The device of claims 5, 6 or 7 in which said bottom wall has a plurality of funnel shaped diffuser blades which are concentrically arranged and thereby define said openings.

* * * * *